United States Patent [19]

Sobut

[11] Patent Number: 4,862,163

[45] Date of Patent: Aug. 29, 1989

[54] TRAFFIC MONITORING SYSTEM

[75] Inventor: Bruce Sobut, Clearwater, Fla.

[73] Assignee: Timelapse, Inc., St. Petersburg, Fla.

[21] Appl. No.: 139,555

[22] Filed: Dec. 30, 1987

[51] Int. Cl.[4] ..... G08G 1/02

[52] U.S. Cl. ..... 340/940; 340/933; 377/9

[58] Field of Search ..... 340/940, 928, 933, 934; 377/9; 364/424, 436, 437

[56] References Cited

U.S. PATENT DOCUMENTS

| | | | |
|---|---|---|---|
| 2,150,776 | 3/1939 | Moles | 377/9 |
| 3,346,842 | 10/1967 | Dixon . | |
| 3,699,398 | 10/1972 | Newmeyer | 340/940 |
| 3,806,908 | 4/1974 | Bound et al. . | |
| 3,900,830 | 8/1975 | Peterson | 340/940 |
| 3,914,733 | 10/1975 | Viracola | 340/940 |
| 3,949,355 | 4/1976 | Newmeyer | 340/940 |
| 3,950,725 | 4/1976 | Kitajima | 340/940 |
| 4,194,194 | 3/1980 | Redfern . | |
| 4,333,029 | 6/1982 | Kolm et al. . | |
| 4,356,423 | 10/1982 | Gudzin . | |

OTHER PUBLICATIONS

Traffic Classifier Model 401, Streeter Amet, 8-23-76 cl. 340-940.

*Primary Examiner*—Joseph A. Orsino
*Assistant Examiner*—Brent A. Swarthout
*Attorney, Agent, or Firm*—Pennie & Edmonds

[57] ABSTRACT

An improved traffic monitoring system is disclosed in which a microprocessor is connected to an analog to digital converter providing a series of digital samples of the pressure within a road tube for analysis of the signals. If a pulse is detected exceeding a threshold level, corresponding to passage of a tire over the road tube at a relatively high rate, the microprocessor then determines whether pressure in the tube subsequently drops below a repetitively-updated baseline value. If the pulse in the pressure does not exceed a predetermined threshold, the microprocessor determines whether the pressure continues to rise for a stated period of time and to exceed a set minimum value, whereupon the conclusion is reached that a relatively slowly moving tire has passed over the road tube. The microprocessor is disabled from detecting a second tire within varying intervals after detection of a pulse. The disable interval is longer for pulses due to passage of fast vehicles than for pulses due to slow vehicles, as increased internal pressure fluctuations are caused by passage of fast moving vehicles over the road tube.

11 Claims, 5 Drawing Sheets

TRAFFIC MONITORING SYSTEM

FIELD OF THE INVENTION

This invention relates to an improved traffic monitoring system. More particularly, this invention relates to an improved traffic monitoring system, which provides more accurate and complete discrimination between vehicles of varying types traveling at different speeds than have prior systems.

BACKGROUND OF THE INVENTION

Prior traffic monitoring systems have typically involved a rubber tube, referred to as a "road tube", having one closed end and the other end in communication with a pressure transducer. The transducer outputs a signal, normally a voltage, responsive to variation of the air pressure in the tube. Accordingly, when a vehicle tire passes over the road tube, momentarily flattening a portion of it, the transducer outputs a signal exhibiting a peak responsive to the changes in pressure in the tube.

Several problems are well known to exist with conventional traffic sensing devices of this type. One is that vehicles passing over the tube at high speeds near the transducer will naturally produce a much more pronounced pressure wave in the tube than vehicles passing at lower speeds or further away from the transducer. Heavier vehicles similarly cause greater signal excursions than do light vehicles. As explained in detail in U.S. Pat. No. 3,949,355 to Newmeyer, these differences in the signal amplitude can be so pronounced that the pressure differential caused by passage of a heavy, fast vehicle overloads a transducer optimized to detect smaller signal variations, while low amplitude signals may not be detected by a transducer capable of reliable detection of high amplitude signals. According to the Newmeyer patent, the transducer assembly may be provided with a venting port to limit high amplitude excursions in the pressure, thus allowing a single transducer to be more appropriately matched to the amplitude of waves received in the road tube.

The Newmeyer patent also recognizes that a particular tire rolling over the road tube may generate a plurality of peaks in the pressure signal, e.g., due to reflection of the initial pressure peak from the ends of the tube. The Newmeyer patent attempts to solve this problem by disabling the traffic counting device from counting any additional vehicles after a particular pulse has been detected. A varying time delay is provided which requires the operator to set up the system in response to anticipated traffic conditions. Departures of the actual traffic from the anticipated traffic—either in traffic density, traffic rate or vehicle type—may cause the system to miscount the actual vehicles.

The Newmeyer patent also recognizes that certain spurious reflections occurring after the primary pressure pulse are normally of steadily decreasing amplitude due to attenuation of the pressure wave in the resilient tube. Accordingly, the Newmeyer patent suggests at column 7, lines 15–25 that a pulse amplitude threshold, to which incoming pulses are compared to determine whether they are likely to have occurred in response to a countable event, should be decreased over time. However, this solution is complicated and can lead to further inaccuracies.

Newmeyer also notes that a single set of vehicle wheels may cause a initial pulse in pressure of a first amplitude and may cause a second pulse of higher amplitude, e.g., due to whipping of the tube against the road, or if a vehicle crosses the tube at an angle such that its wheels do not compress the tube simultaneously. In order to remove these effects from contributing spurious counts to the traffic measurement, Newmeyer again suggests disabling the system from counting a second pulse within an operator-chosen predetermined period after a first pulse. However, as noted above, this approach demands that the operator set the system up correctly for the anticipated traffic conditions. This may or may not always be possible or convenient.

Accordingly, it can be seen that there exists a need in the art for an improved traffic monitoring system of increased sophistication over those available in the art, which provides accurate discrimination between fast and slow vehicles, and between heavy and light vehicles, which refuses to respond to spurious reflection of a pressure wave within the tube, and which is capable of distinguishing closely spaced axles such as those of two-axle trailers from one another. Simply providing an operator-selectable time delay together with means for attenuating higher amplitude pulses, as disclosed in the Newmeyer patent, is not sufficient. Ideally a device which unambiguously detects passage of a vehicle over the road tube is needed.

SUMMARY OF THE INVENTION

According to the present invention, a piezoresistive transducer connected to a road tube outputs an analog signal indicative of pressure within the tube. The baseline pressure level within the tube is constantly recorded, to compensate for variations in the ambient temperature and pressure. When a vehicle tire compresses the road tube momentarily, the transducer outputs a voltage signal indicative of pressure therein. This is amplified and sampled at regular intervals by an analog to digital converter. The digital samples are supplied to a microprocessor, where they are stored for analysis. The microprocessor detects initial peaks and then analyzes the subsequent signal pattern to determine the characteristics of the vehicle.

According to an important aspect of the invention, it has been found that the pressure signal typically drops below the baseline level sometime after the initial peak, due to resonant effects in the tube, and this fact is used to discriminate between various types of events occurring in the pressure signal over time. The spacing between the initial peak in the signal and the point at which the signal drops below zero can be used to determine the rate of speed of the vehicle, while the amplitude of the initial pulse relates both to its speed and its weight. Accordingly, analysis of the received signal by the microprocessor, particularly with respect to the baseline, can be employed to distinguish between a wide variety of different traffic patterns. This sophisticated analysis technique allows the system to be very sensitive to low-level signals, effectively improving the system signal-to-noise ratio with respect to prior systems.

BRIEF DESCRIPTION OF THE DRAWINGS

The invention will be better understood if reference is made to the accompanying drawings, in which.

DESCRIPTION OF THE PREFERRED EMBODIMENTS

Figure 1:
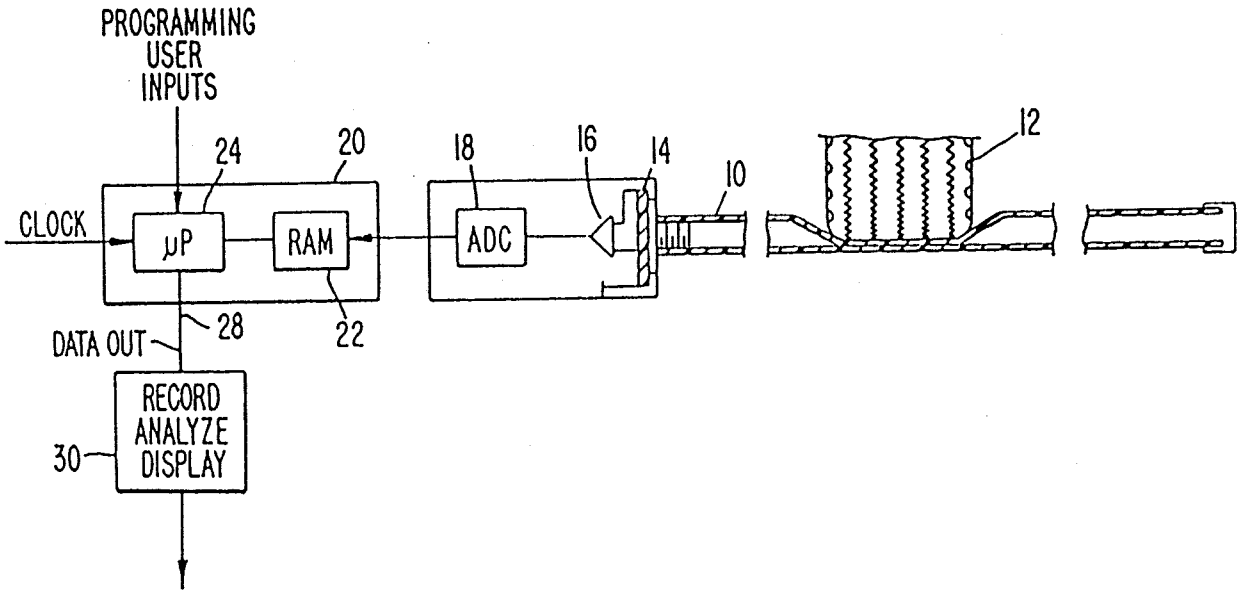
FIG. 1 shows a block diagram of a traffic recording system according to the invention.

The system of the invention is shown in schematic form in FIG. 1. A road tube 10 formed of a resilient material such as rubber contains a chamber of air. When a vehicle tire 12 passes thereover, the pressure in the tube changes in a manner which is a relatively complex function of the speed of the vehicle, its weight, the compliance of the tube, the ambient air pressure therein, the temperature, and a host of other factors. According to the present invention, these factors are taken into account in analysis of the traffic pattern.

A piezoresistive or other transducer 14 which is in communication with the chamber in the tube 10 outputs a voltage signal responsive to the pressure in the tube. For example, the model no. SX-01DN from Sensym, Inc., of Sunnyvale Calif. is suitable as transducer 14; Motorola and Honeywell units are also suitable. This signal is amplified as needed by an amplifier shown at 16, and is sampled and converted to digital form in an analog to digital converter 18. The digital signal, which comprises a series of digital samples, which may usefully be taken at a frequency of at least 1 (one) kHz, is supplied to an analysis/storage unit 20 which may comprise a random access memory 22 for storing the samples until they can be analyzed by a microprocessor 24. Alternatively, as is well understood by those skilled in the art, the microprocessor 24 may itself comprise sufficient random access memory to store the samples, or may store and analyze them essentially in real time. The microprocessor 24 receives programming inputs from a user as indicated at 26; that is, when the unit is installed at a particular traffic location, the operator provides various control inputs in arranging it to record whatever data is desired. As indicated at 28, data output by the microprocessor is stored on a recording/display unit 30 for immediate or subsequent analysis and display as needed. According to an important aspect of the present invention, additional analysis of the received pressure signal is performed to yield additional traffic information.

Figure 2:
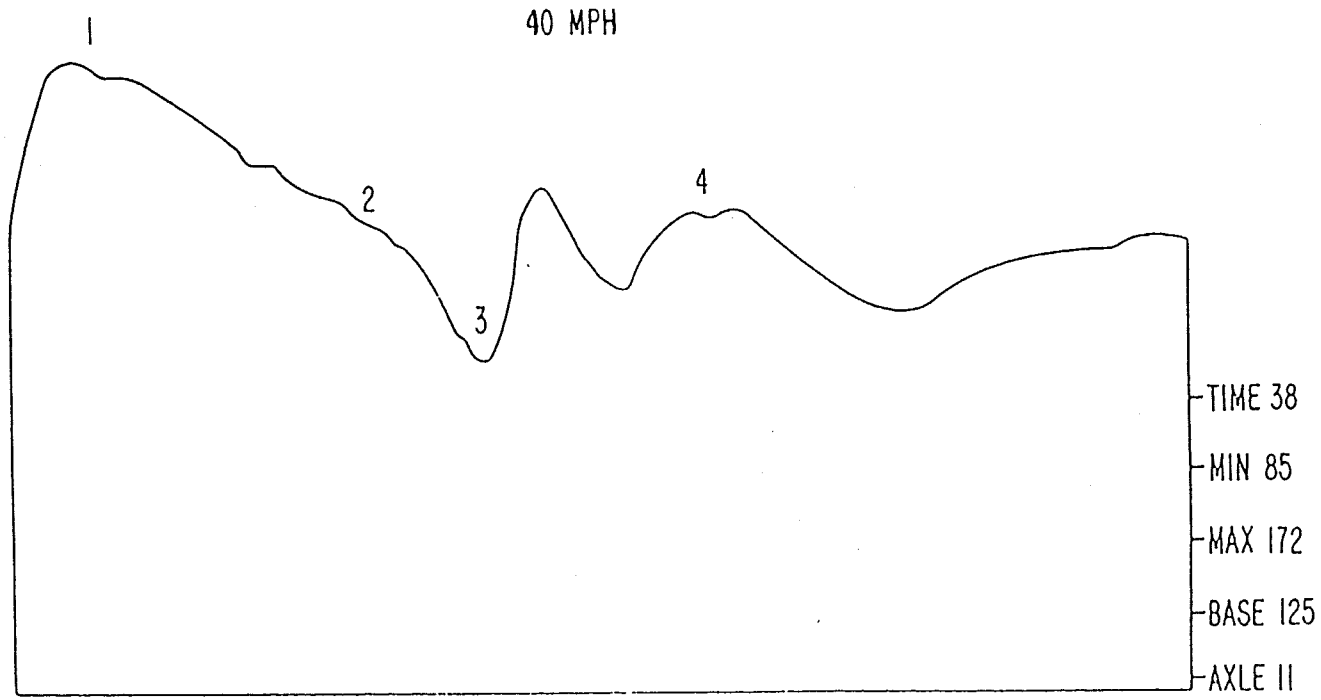
FIGS. 2, 3 and 4 show exemplary data received from the detection device shown in FIG. 1.
Figure 3:
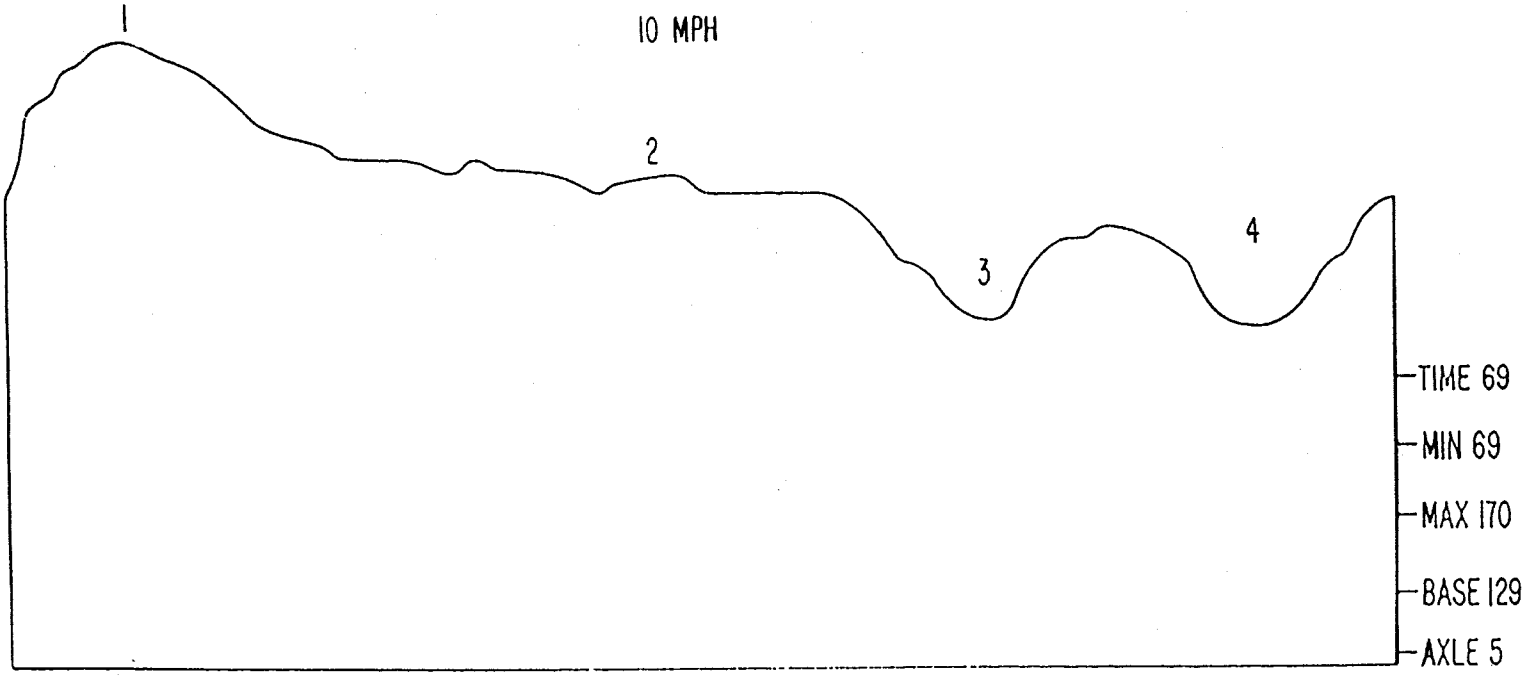
Figure 4:
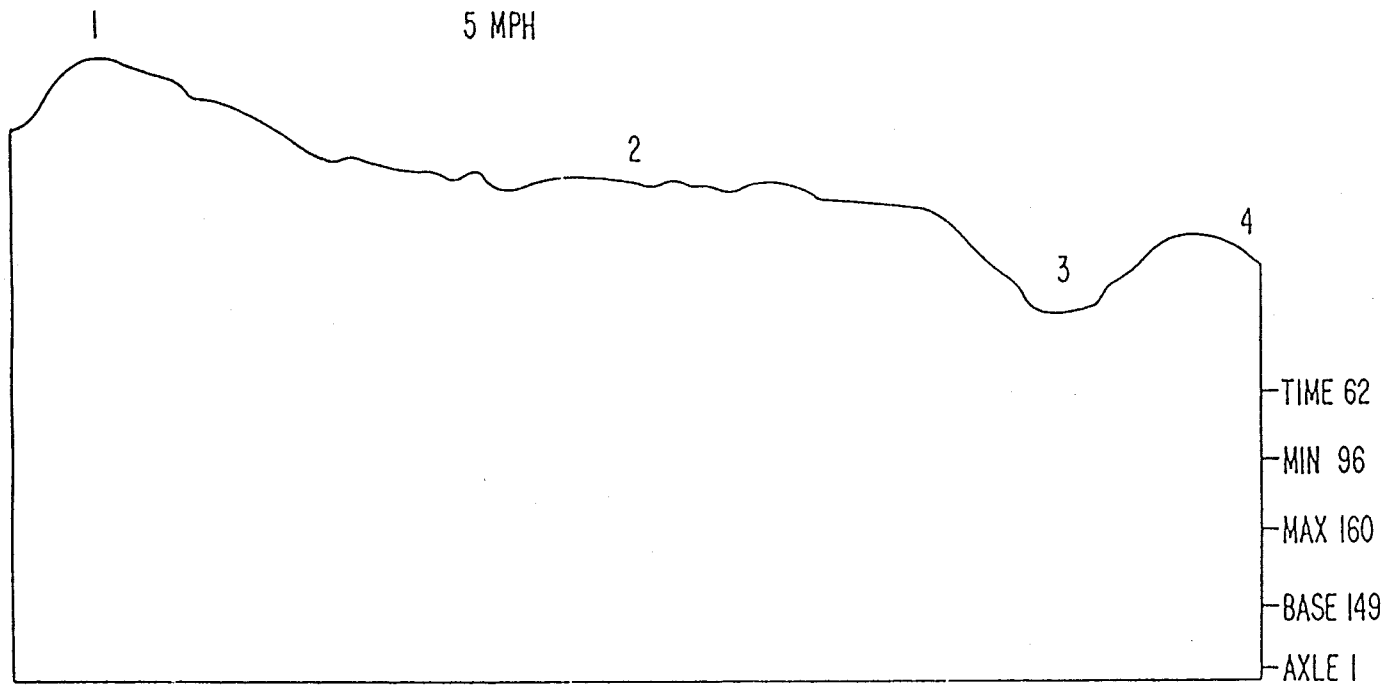

Shown in FIGS. 2, 3 and 4 are typical data records received from the piezoelectric sensor 14, wherein the individual vertical lines shown each represent the relative "height" of the sampled signal at intervals of time, the horizontal axis representing time. These samples were taken at 0.5 msec. intervals, such that the total time of the displays shown in each of FIGS. 2–4 is approximately 30 msec.

FIG. 2 shows a typical sample record for a tire passing over the road tube at 40 mph; FIG. 3, a similar showing for a tire passing at 10 mph; and FIG. 4, a similar showing at 5 mph. In each case, there is an initial steep rise in the pressure signal, as indicated at point 1 in each of FIGS. 2–4. The signal then decreases to a baseline level 2, which is recorded continually, according to an aspect of the invention. In this way constant compensation for variations in the ambient temperature or pressure, which affect the pressure within the tube 10, may constantly be made.

According to an important aspect of the invention, the inventor has realized that the signal responsive to passage of a tire over the road tube then normally decreases to a level, shown at 3, which is lower than the baseline level 2. This is thought to occur when the tire leaves the tube, that is, when the tube is allowed to return to its uncompressed position. Finally, one or more damped pulses 4 due to reflection of the pressure signal from the ends of the tube may also typically appear.

According to the invention, microprocessor 24 detects the dropping of the pressure signal below the baseline level 2 at points 3 in the received signal, and employs this to discriminate between passage of various types of vehicles over the road tube and various effects caused by weight of the vehicle, spacing of the axles and the like. More particularly, the fact that the signal does drop below the baseline level at points 3, at least after passage of a tire of some minimum weight, means that by noting when this occurs an unambiguous detection of passage of a tire over the road tube can be detected. It is a simple matter to measure the spacing between the initial peaks 1, and the rest of the wave form, e.g. point 3, to measure the speed of the tire over the tube. Similarly, it is straight forward to measure the height of the initial peak 1 to derive an indication of the weight of the vehicle, to monitor the spacings of successive vehicles to determine the closeness of their passage, that is, to determine the overall traffic density, and to similarly derive other well understood parameters of traffic.

Figure 5:
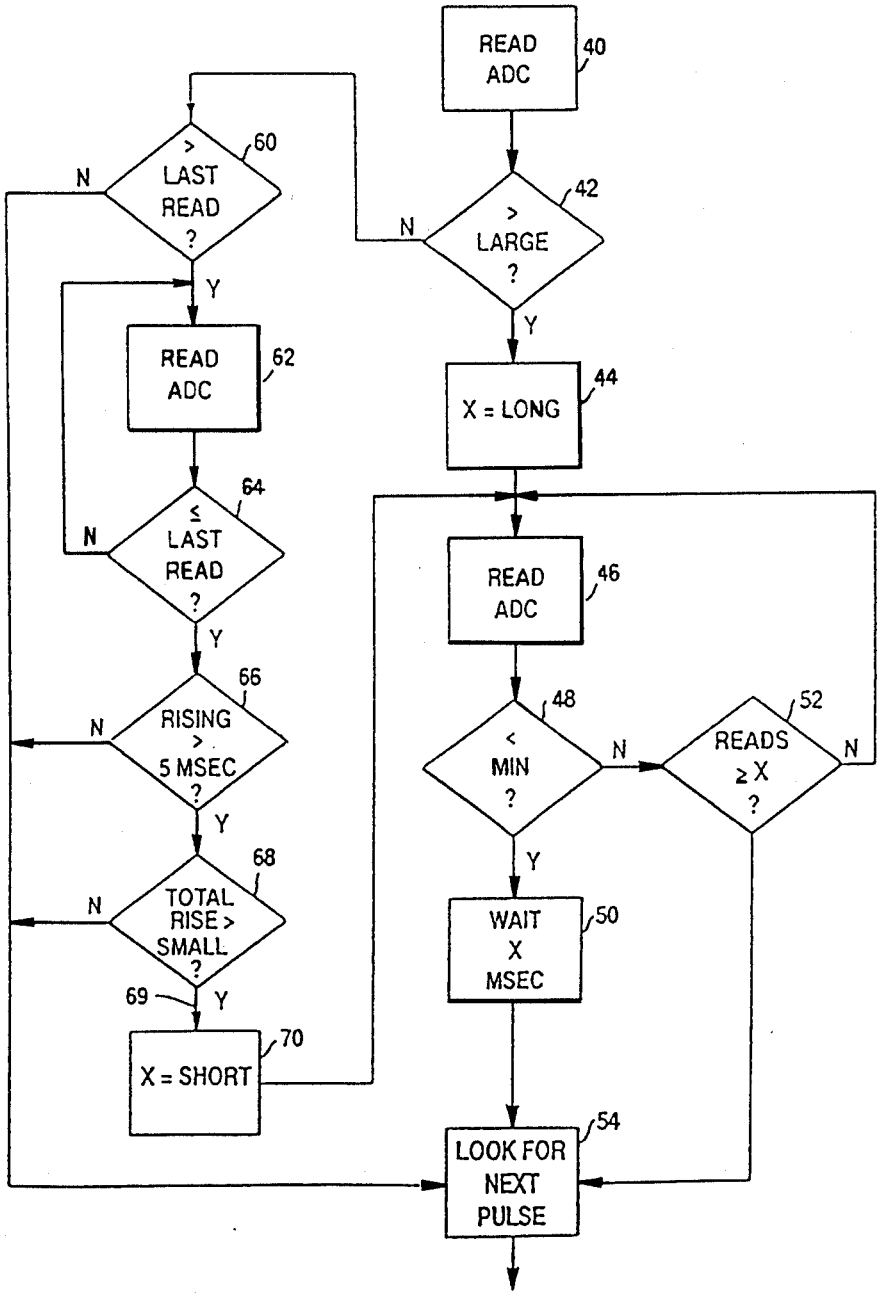
FIG. 5 shows a block diagram of analysis operations performed by the microprocessor of the traffic monitoring system according to the invention.

FIG. 5 shows schematically an example of the process by which the microprocessor discriminates between types of traffic by analysis of pulses in the road tube due to tires of vehicles passing over the road tube 10. In the example, the microprocessor distinguishes between tires of fast vehicles and tires of slow vehicles, and only detects passage of tires of faster vehicles using the technique described above, that is, by determining after each peak whether the pressure drops below baseline; other techniques, described below, are used to detect passage of slower vehicles. After detection of a pulse in the pressure, it is desirable to disable detection of another pulse to allow these internal variations in the pressure to be dispersed. It is found by the present inventor that variation of the air pressure in the road tube persists longer after a fast-moving vehicle tire compresses the tube than when a slow-moving vehicle does so. Accordingly, the disable time, after which the system "looks" for the next tire to pass over the road tube 10, is controlled to be longer after passage of a tire of a fast vehicle than in the case of a slower vehicle. The system thus discriminates between the length of the "disable time" provided responsive to the speed of passage of the various tires not because fast vehicles will typically pass more closely together in time, but to allow variation of the time taken for the air pressure within the tube to settle.

In an initial step 40, the analog to digital converter 18 is read, that is, a sample is accepted therefrom. The sample is compared to a known value termed "large" at step 42. "Large" is a constantly reset function of the baseline, such that the comparison step 42 determines whether the latest sample is larger than the baseline value currently stored by some predetermined amount. If so, a variable X, relating to the delay time to be implemented before the system will accept another pulse, is set in step 44 equal to a value termed "long"—that is, the disable time will be relatively long. Thus, when a fast moving vehicle passes over the road tube 10, and the pressure in the tube exceeds "large" detected at step 42, a longer disable period during which the system is prevented from concluding that a subsequent pulse has been caused by passage of another tire, is implemented in step 44. Thereafter, the analog to digital converter is read again at step 46. Whether the next value read is less than a previously stored value termed "min" is determined in a step 48. "Min" is a function of the baseline value, and is always controlled to be less than the baseline value. If so, the system waits for X msec at step 50 before it will accept another pulse as indicative of passage of another tire. This step thus detects whether the pressure goes below the baseline value, as indicated at points 3 in FIGS. 2–4. If the signal read at 46 is greater than "min", and if the delay period X has passed as indicated at 52, then a subsequent pulse is looked for at 54; if not, the loop beginning with reading the convertor at step 46 is reentered. As can be seen, this loop proceeds until the value of the pressure drops below "min", that is, until the point at which the pressure drops below baseline is detected.

If the pulse measured in step 42 was not greater than "large", it is compared at 60 to the last pulse read. If the pulse is greater than the last pulse read, this indicates that the pulse is rising slowly; this can occur, for example, due to a tire passing over the road tube slowly. The convertor is then read again at 62 and the result compared to see whether it is less than or equal to the "last read" value; if it is, as indicated at 64, the end of the rising of the pulse has been detected. If the total rise took more than 5 msec. as detected at 66, and was greater than some minimum value termed "small", detected at 68, then it is determined at 69 that passage of a slow moving tire has been detected. In this case, time delay X, during which the system is disabled from interpreting another pulse as indicating passage of another tire, is set equal to a value termed "short", which is less than "long". As discussed above, these steps implement an important recognition made by the invention, that is, that the pressure variation in the tube is substantially greater and lasts for a longer period of time with respect to fast moving tires than with respect to slower ones.

If the test made at 64 is negative, that is, if the pulse is greater than the last read pulse, then the pressure is still rising and the loop comprising test steps 62–64 continues until the pulse does flatten, whereupon steps 66 and 68 are performed. On the other hand, if the pulse flattens before 5 msec. has gone by, or if the total rise does not exceed the value set for "small", then the pulse is deemed not to be a tire pulse but due to an individual's stepping on the road tube or the like; in this case the next pulse is simply looked for at 54. The shape of the pulse is thus employed to discriminate between pulses due to passage of tires and other causes.

It will be appreciated that there has been described a system in which a microprocessor is employed to discriminate between various traffic events as well as individuals stepping on the tube or other events. The invention includes the inventor's realization that when a tire passes over the road tube there is occasioned a negative going pulse in the pressure with respect to a baseline level, at least under certain circumstances. The system is disabled from accepting a further pulse for a varying length of time depending on whether a fast or slow moving vehicle tire has been detected. The shape of the pulse may also be monitored for discrimination between tire-passing pulses and other pulses. Accordingly, the system is rendered increasingly foolproof with respect to systems which do not provide the sophisticated analytical technique described.

As noted, the sophisticated analytical technique provided by employment of the microprocessor according to the invention makes the system of the invention responsive to signals of much lower amplitude than are other devices, for example, which merely compare the signal to a stored threshold value to detect a pulse. By actually analyzing the wave form according to the invention, effectively higher signal to noise ratios may be reached. For example, the system of the invention is capable of detecting passage of a bicycle. A conventional system would not be capable of discriminating the low-amplitude signal provided by passage of such a light vehicle from noise. This would especially be the case if the system were set to a low overall gain figure, so as to avoid transducer overload upon passage of heavy vehicles. The increased signal to noise ratio provided by the invention allows reduction of the overall system gain, avoiding transducer overload, while yielding high sensitivity.

The subsequent processing of the data generated according to FIG. 5, that is, monitoring successive similar impulses to determine the speed of vehicles, monitoring pairs of detected impulses with respect to other pairs to determine the net traffic flow density, and other analytical techniques, are deemed to be within the skill of the art, such that they do not require, a specific disclosure herein. For example, the inventor notes that dual-axle trailers moving at high speeds typically cause a peak 1 in the waveform to follow the preceding dip 3 relatively closely, e.g., at 35–40 msec intervals for vehicles moving at 75 mph. The microprocessor can readily detect such events and record the traffic statistics appropriately.

Thus, while a preferred embodiment of the invention has been described, it will be appreciated that there are numerous modifications and improvements which can be made thereto without departure from its spirit and scope, and that it is therefore not to be measured by the above exemplary disclosure but only by the following claims.

I claim:

1. A traffic monitoring system, comprising:

a tube formed of a resilient material and defining an interior air chamber, adapted to be disposed transversely to a roadway, traffic on which is to be monitored;

a pressure sensing element generating an analog signal responsive to air pressure in said chamber;

means for sampling said signal at intervals of time, providing a sequence of samples;

means for repetitively storing ones of said samples to provide a continuously-updated baseline value of said signal;

means for analyzing variation in said signal as a function of time to determine the speeds and types of vehicles passing over said tube;

wherein said means for analyzing analyzes said samples by comparing the sequence of samples to said baseline value, detects peaks in the pressure in said chamber, and determines that ones of said peaks are responsive to a vehicle tire passing over said tube upon detection of subsequent reduction in the pressure in said tube to a value below said baseline value, thus discriminating between pulses in the pressure in said tube due to tires passing over said tube and other pulses.

2. The system of claim 1, wherein said pressure sensing element is a piezoresistive transducer.

3. The system of claim 1, further comprising means for amplifying said signal prior to sampling thereof.

4. The system of claim 1, wherein said means for sampling comprises an analog-to-digital converter means.

5. The system of claim 4, wherein said means for analyzing comprises microprocessor means.

6. The system of claim 1, wherein the microprocessor measures the time between a positive peak in the pressure and subsequent reduction to below the baseline value in order to measure the speed of the vehicle.

7. The system of claim 6, wherein said microprocessor further measures the height of peaks in the pressure in the tube with respect to the baseline level and determines an amount of time during which the system is disabled from determining that subsequent pulses are due to vehicles passing thereover, responsive to the height of said peaks.

8. A method of monitoring the flow of traffic employing a system comprising a road tube consisting of a resilient tube defining an air chamber therein coupled to a transducer for outputting a signal responsive to changes in the air pressure within said tube, and a microprocessor for analyzing said pressure signals as a function of time, comprising the steps of:

comparing the signal at intervals of time with a baseline value of said signal, said baseline signal being repetitively measured in order to be responsive to changes in ambient pressure and temperature conditions;

when an increase in pressure is detected, comparing said increase to a predetermined threshold level to determine whether said increase is of a relatively greater or relatively lesser extent with respect to said baseline value;

if said increase in pressure in greater than said threshold value, examining subsequent pressure signal variations for indication that said pressure signal has dropped to beneath a predetermined value less than said baseline value, and if such dropping of the pressure below said value is detected, disabling said microprocessor from detecting a subsequent pulse for a first period of time; and if said increase in pressure is less than said threshold value, disabling said microprocessor from detecting a second pulse for a second predetermined period of time less than said first predetermined period of time.

9. The method of claim 8, wherein if said increase in pressure is less than said threshold value, the rate of change of the pressure in time is analyzed to determine whether said increase is due to a passage of a vehicle over said tube.

10. A method of monitoring traffic, employing a system generating a series of digital samples responsive to changes in pressure in a road tube disposed laterally across a roadway traffic along which is to be measured, comprising the steps of detecting and discriminating between pulses in the pressure, by:

comparing detected pulses to a threshold value in order to determine whether particular pulses detected with respect to said road tube are greater or lesser than said threshold value;

if said pulse is greater than said threshold value, determining whether it is closely followed by a dropping of the pressure in said road tube below a baseline level established prior to detection of said pulse in said pressure, and if so, counting said pulse, and disabling said system from counting another pulse within a predetermined period of time; and if said pulse is less than said threshold value, determining whether the pressure continues to rise during said pulse for a predetermined period of time and whether it ultimately exceeds a predetermined minimum value, and if these conditions are met, counting said pulse, and disabling the system from counting a second pulse for a second lesser predetermined period of time.

11. A method of traffic analysis wherein a series of digital samples are provided to a microprocessor from an air pressure sensor connected to a road tube, comprising the steps of:

determining whether a particular pulse detected by said microprocessor exceeds a first threshold, and is said pulse exceeds said threshold first determining whether the pressure in the tube subsequently falls beneath a repetitively-updated baseline level, thus indicating unambiguously the passage of a tire over said road tube; and, if so, counting said pulse and avoiding counting a subsequent pulse for a first period of time; and if said pulse does not exceed said first threshold but is greater than a second lesser threshold, indicating that the pulse corresponds to detection of passage of a tire over the road tube, counting said pulse, and avoiding counting a subsequent pulse for a second lesser period of time.

* * * * *